United States Patent [19]

Gueret

[11] Patent Number: 4,774,973

[45] Date of Patent: Oct. 4, 1988

[54] CASING, SUCH AS A MAKE-UP COMPACT, COMPRISING A SIMPLIFIED CLOSING DEVICE

[75] Inventor: Jean-Louis Gueret, Paris, France

[73] Assignee: L'oreal, Paris, France

[21] Appl. No.: 24,144

[22] Filed: Mar. 10, 1987

[30] Foreign Application Priority Data

Mar. 11, 1986 [FR] France ..... 86 03413

[51] Int. Cl.[4] ..... A45D 33/00

[52] U.S. Cl. ..... 220/326; 132/293

[58] Field of Search ..... 132/79 R, 79 F, 79 D, 132/82 R, 83 R, 79 G; 220/326

[56] References Cited

U.S. PATENT DOCUMENTS

| | | | |
|---|---|---|---|
| 1,931,216 | 10/1933 | Zell | 220/326 |
| 2,039,205 | 4/1936 | Anderl | 132/82 R |
| 4,387,730 | 6/1983 | Shioi | 132/83 R |
| 4,399,826 | 8/1983 | Ogasawara | 132/83 R |
| 4,454,889 | 6/1984 | Contreras, Sr. | 132/82 R |
| 4,474,196 | 10/1984 | Yuhara | 132/83 R |
| 4,483,355 | 11/1984 | Yuhara | 132/83 R |
| 4,580,586 | 4/1986 | Kitoh et al. | 132/83 R |
| 4,589,431 | 5/1986 | Yuhara | 132/83 R |
| 4,595,028 | 6/1986 | Yuhara | 132/83 R |
| 4,679,576 | 7/1987 | Yuhara et al. | 132/82 R |
| 4,683,899 | 8/1987 | Yuhara et al. | 132/82 R |
| 4,696,317 | 9/1987 | Shioi et al. | 132/82 R |

FOREIGN PATENT DOCUMENTS

| | | | |
|---|---|---|---|
| 31134 | of 1884 | Fed. Rep. of Germany . | |
| 2411942 | 7/1979 | France . | |
| 2471326 | 6/1981 | France | 132/79 R |
| 2546137 | 11/1984 | France | 132/82 R |
| 2106977 | 4/1983 | United Kingdom | 132/79 R |
| 2140392 | 11/1984 | United Kingdom | 132/82 R |

*Primary Examiner*—Gene Mancene
*Assistant Examiner*—Michael Lynch
*Attorney, Agent, or Firm*—Cushman, Darby & Cushman

[57] ABSTRACT

The closing device of a compact is constituted on the one hand by a movable component carried by a base of the compact and comprising a V-shaped element constituted by a manipulating push button and by a flexible catch engagement arm carrying, on the opposite side to the push button a bead and, on the other hand, a catch of the lid intended to receive the bead in the closed position. To open the lid, the push button is depressed so as to cause the flexible arm to bear against a suitably disposed bearing surface of the base in order to release the bead from the catch. The V-shaped element can be carried by a flexible strip forming part of a shell introduced into the base and comprising a hinge element whose other element is carried by the lid.

17 Claims, 2 Drawing Sheets

CASING, SUCH AS A MAKE-UP COMPACT, COMPRISING A SIMPLIFIED CLOSING DEVICE

FIELD OF THE INVENTION

The present invention relates to a casing composed of a base and a lid articulated on the base by a hinge. The invention may be applied to all kinds of casings but it is particularly suitable for application to compacts containing cosmetic products. For storing and presenting make-up products such as eye shadow or powder, the cosmetic and perfumery industries use many different kinds of make-up compacts containing tablets of make-up or of compacted powder, and possibly accessories such as applicator brushes.

PRIOR ART

French Patent No. 2,546,386 and its first Certificate of Addition No. 2,560,507 disclose a compact comprising two main elements mounted to pivot on each other by means of a hinge and consisting of, on the one hand, a base and a lid both moulded from a relatively rigid plastic material and, on the other hand, an intermediate shell moulded from a relatively flexible plastic material and mounted in one of the two main elements, preferably in the base of the compact. This base is provided with a closing device comprising at least one pair of components having parts of complementary shapes, one of them being movable. The shell carries the or each movable component of the closing device, such movable component(s) being accessible from the outside of the compact. The or each such component of the closing device, thus carried by the compartment defined in the base, can be advantageously moulded integrally with the compartment, and the above mentioned French patent as well as its Certificate of Addition, present various closing systems making use of the flexible or semi-flexible nature of the material constituting the shell.

With the purpose of reducing the manufacturing costs by proposing a make-up compact which is simple to manufacture and easy to assemble, of enhancing the aesthetic aspect of the finished product, and of facilitating the user's opening and closing actions, the present applicants have perfected a new closing system reconciling all the necessary requirements: a secure lock, easy opening, and a simple structure while avoiding any complication of both the structure of the unit and its assembly.

SUMMARY OF THE INVENTION

In accordance with the invention, the or each movable component of the closing device, advantageously carried by the base of the casing, comprises an element which, in a particularly preferred embodiment, has a V-shaped profile, one side of which constitutes a manipulating push button projecting from the casing in the closed configuration of the casing and the other, relatively flexible, side of which constitutes a catch-engagement arm whose free end on the opposite side to the push button is shaped as a catch-engagement bead capable of cooperating with a catch which constitutes the fixed component associated with the closing device and which is carried by the other casing element, in this case the lid. To open the lid the manipulating push button is depressed to cause the catch-engagement arm to bear on a suitably disposed bearing surface of the base, the catch-engagement arm then being capable of emerging from the catch of the lid by virtue of its flexibility.

The present invention therefore provides a new industrial product constituted by a casing, in particular, a make-up compact, comprising two main elements, that is to say, a base and a lid mounted to pivot on each other by means of a hinge and capable of being kept applied to each other in the closed configuration of the compact by a closing means comprising at least one pair of components, each such component being carried by one of the two main elements of the compact and having parts of complementary shape for fixing said main elements together, one of the components being movable in order to allow the actuation of the closing means and to actuate the closing and opening of the compact, characterised in that the or each movable component of the closing means which is carried by one of the elements of the compact comprises, on the one hand, a manipulating push button which projects from the compact in the closed configuration of the compact and, on the other hand, a relatively flexible catch-engagement arm joined to the manipulating push button on the proximal end thereof, the manipulating push button and the catch-engagement arm forming an acute angle, the catch-engagement arm ending in a catch-engagement bead remote from the manipulating push button, the other element of the compact having a catch capable of cooperating with said catch-engagement bead, the catch-engagement bead and the catch constituting parts of complementary shape intended to ensure the closure of the compact, the element of the compact which carries the or each movable component of the closing means comprising a fixed bearing surface on which the catch-engagement arm is capable of bearing during the action of depressing the manipulating push button when the compact is in the closed configuration, the apex of said acute angle then being below the plane parallel to the median plane of the compact and passing through the fixed bearing surface to release the catch-engagement bead from the catch.

Preferably, the or each manipulating push button is disposed substantially perpendicular to the median plane of the compact.

Moreover, the manipulating push button and the catch engagement arm of the or each movable component of the closing means form together an angle which is preferably approximately 45°.

The manipulating push button may comprise a stop limiting its displacement in the direction of extraction from the compact, when the compact is closed; the compact may comprise an opening component which separates the lid from the base when the or each movable component of the closing means is manipulated; and the lid may comprise an opening allowing the catch-engagement bead to be released from the catch during the action of opening the compact.

In a particular embodiment of the present invention, the part constituted by the manipulating push button and the catch engagement arm of the or each movable component is supported in the element of the compact with which said movable component is associated, by a flexible strip which is fixed at each of its ends to said element of the compact or to a component integral therewith.

Moreover, the manipulating push button and the catch engagement arm of the or each movable component advantageously constitute a single part moulded of a relatively flexible plastic material.

In this latter case, when the support for the part constituted by the manipulating push button and the catch engagement arm is constituted by a flexible strip, this strip is preferably obtained by moulding, together with the said part or parts.

Furthermore, it is advantageous for the or each movable component of the closing means to be carried by the base, the catch intended to cooperate with the catch-engagement bead of the or each said movable component being carried by the lid.

In that case, the or each movable component of the closing means can be supported by an intermediate shell mounted in the base and delimiting with the base at least one compartment of the compact. The above-mentioned support constituted by the flexible strip may form part of this shell.

The bearing surface against which the catch-engagement arm bears is advantageously constituted by the upper edge of a rib carried by the base.

Preferably, in the closed position of the compact, the manipulating push button passes through the lid.

It can be arranged that in the closed position, the manipulating push button passes through an intermediate shell mounted in the base and delimiting with the base at least one compartment of the compact.

In the case where the compact according to the invention comprises a shell, this shell can carry one of the hinge elements, the other hinge element being carried by the lid.

BRIEF DESCRIPTION OF THE DRAWINGS

In order that the present invention may more readily be understood, three embodiments represented in the attached drawings will be described below by way of purely illustrative and non-restrictive examples. In these drawings.

DESCRIPTION OF THE PREFERRED EMBODIMENTS

Figure 1:
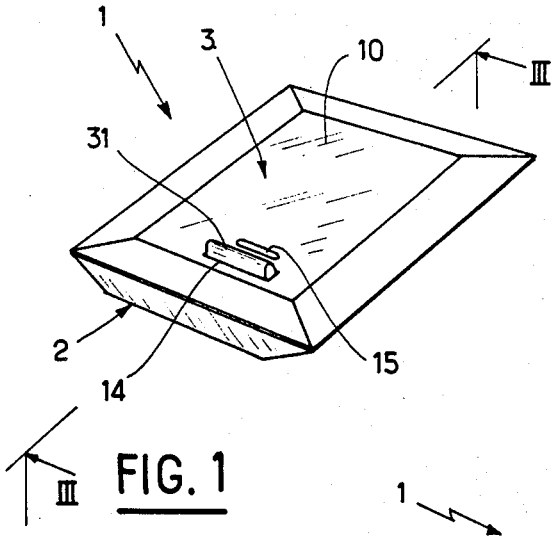
FIG. 1 is a perspective view of a compact in accordance with a first embodiment of the present invention, in the closed configuration.
Figure 2:
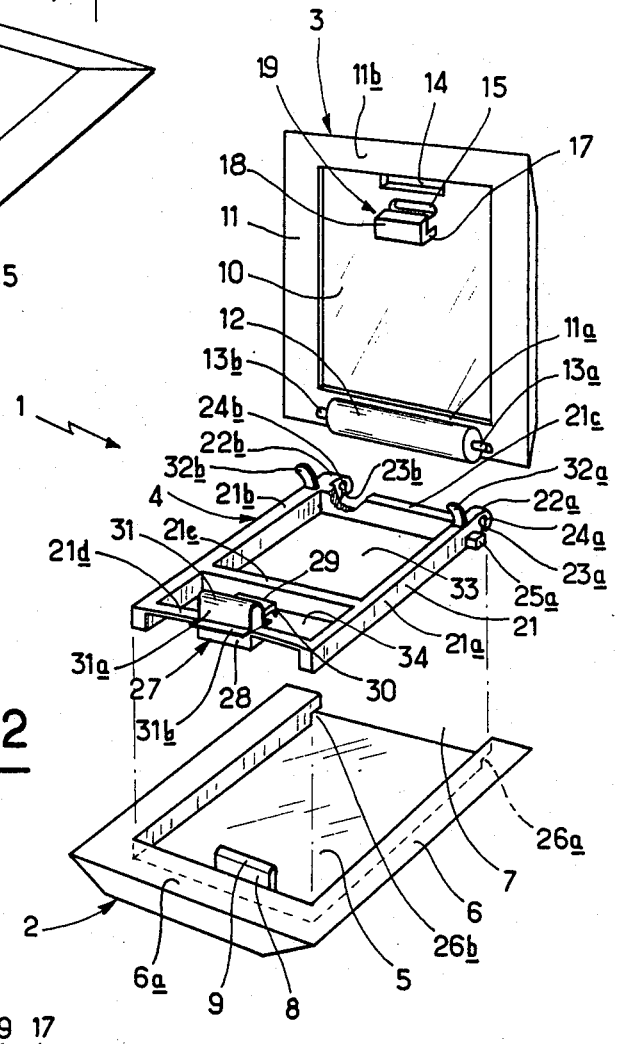
FIG. 2 is an exploded perspective view of the compact of FIG. 1, in the open configuration.

FIGS. 1 to 5 of the attached drawings show a make-up compact 1 as a whole, consisting of a base 2, a lid 3 and an intermediate shell 4. These three parts are moulded from a plastic material, the base 2 and the lid 3 of a relatively rigid plastic material such as polystyrene, and the shell 4 from a plastic material more flexible than the base 2 and the lid 3, such as polypropylene, acronitrilebutadiene-stryene (ABS), polyacetals, and any other slightly elastic thermoplastic material.

The base 2 comprises a bottom 5 in the general shape of a rectangle and surrounded by a ledge 6 disposed perpendicularly over its internal surface, except along the long side which constitutes its rear edge so as to delimit at the rear a clearance 7 whose function will be indicated below.

Moreover, perpendicular to the bottom 5 of the base 2, on the side adjacent the ledge 6 and parallel to the front side 6a of the ledge 6, is a centrally disposed rectangular rib 8 which is joined to the bottom 5 along one of its longitudinal edges. The upper longitudinal edge of the rib is substantially at the same level as the upper faces of the ledge 6 of the base 2.

Figure 3:
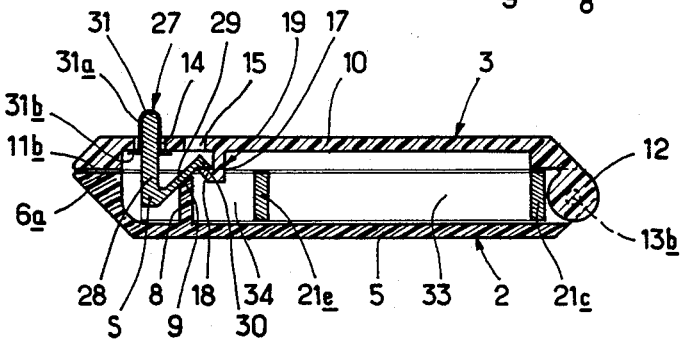
FIG. 3 is a cross-sectional view along III—III of FIG. 1.
Figure 4:
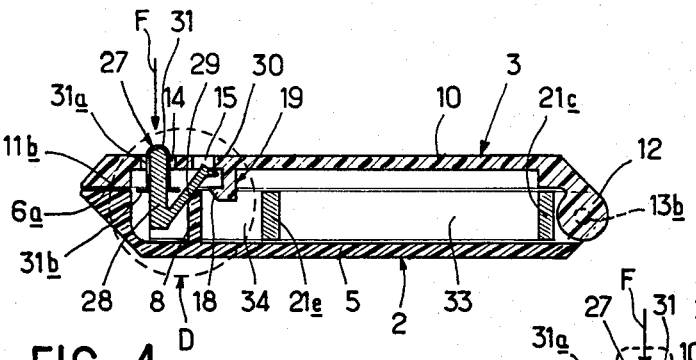
FIG. 4 is a view similar to FIG. 3 showing the catch-engagement arm of the movable component of the closing device carried by the base, as its catch-engagement bead is being released from the catch carried by the lid during the action of opening the compact.
Figure 5:
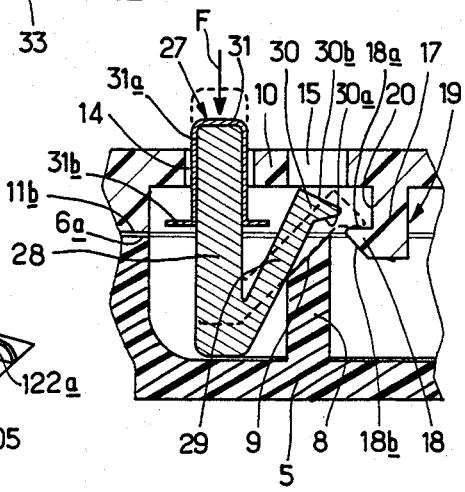
FIG. 5 is a view on an enlarged scale of the detail D of FIG. 4, the push button being represented in its end-of-travel position during the action of opening the lid.

Furthermore, as may be seen in FIGS. 3 to 5 in particular, the rib 8 has an upper edge 9 sloping downwardly towards the front side **6*a* of the ledge 6**.

The lid 3 is constituted by a plate 10 which is also generally rectangular and which is provided with a peripheral ledge 11. The dimensions of the lid 3 are calculated in such a way that it can be applied exactly against the upper face of the ledge 6 of the base 2 in the closed configuration of the compact 1.

Along its rear edge, and at the centre of this edge, the lid 3 carries a cylindrical boss 12 projecting from the internal surface of the lid 3. The boss 12, whose axis is parallel to the rear edge **11*a* of the lid 3, carries externally two axial pins 13*a*, 13*b***, whose function will be indicated below.

The plate 10 of the lid 3 moreover comprises, near its front edge **11*b*, a slot 14 having the form of an elongate rectangle whose axis of longitudinal symmetry is parallel to the rear edge 11*a* and the front edge 11*b* of the lid 3**.

Near the slot 14 and on the side thereof remote from the edge **11*b*, is a rectangular opening 15 smaller in size than the slot 14 and also formed in the plate 10 of the lid 3. The transverse plane of symmetry of the slot 14 and of the opening 15 is identical with the plane of symmetry of the lid 3**.

Near the edge delimiting the opening 15 in the plate 10, on the opposite side to the front edge **11*b* of the lid 3, the plate 10 comprises internally a tongue 17 perpendicular to the plate, the tongue 17 having at its free end on its side nearer the opening 15 a protuberance 18 comprising a side 18*a* parallel to the plate 10 and situated opposite the plate and a sloping opposite side 18*b* joining the side 18*a* at the free end of the protuberance. The tongue 17 and the protuberance 18 constitute a catch 19 which forms, together with the plate 10, a groove 20** whose function will be indicated below.

The shell 4, intended to be mounted in the base 2 by elastic catch-engagement, is constituted by a rectangular frame 21 comprising two longitudinal sides **21*a*, 21*b* joined to a rear transverse side 21*c* and a front transverse side 21*d*. The frame 21 also comprises an intermediate transverse side 21*e* which is nearer to the side 21*d* than the side 21*c*. The two longitudinal sides 21*a* and 21*b* are extended at the rear beyond the rear transverse side 21*c* by two hinge bearings 22*a*, 22*b*** respectively.

Each of these bearings **22*a* and 22*b* consists of a channel-shaped element opening downwardly via a passage 23*a*, 23*b* respectively narrower than the diameter of a said pin 13*a*, 13*b* and delimited between the two flexible sides of the channel-shaped element, this passage 23*a* or 23*b* opening out into a cylindrical recess 24*a*, 24*b*** respectively, whose axis is parallel to the transverse sides 21c, 21d, 21e of the shell 4. A respective pin 13a, 13b of the lid 3 is intended to be rotatably mounted in each passage 23a and 23b.

The lid 3 is thus articulated on the shell 4 by elastic catch-engagement of the pins 13a, 13b in the recesses 24a, 24b of the hinge bearings 22a, 22b. When the shell 4 is mounted in the base 2 the hinge bearings 22a, 22b are themselves elastically catch-engaged by outwardly projecting parts, only the part 25a being visible in the respective slots 26a, 26b in the internal portion of the lateral edges of the ledge 6 delimiting the clearance 7. In this way the hinge constituted by the cylindrical boss 12 of the lid 3 and its pins 13a, 13b, as well as by the hinge bearings 22a, 22b, is inserted in the space determined by the base 2 and the lid 3 without any detrimental effect on the aesthetic aspect of the compact 1 and without any passage being visible from the outside.

The sides 21a, 21b, 21c and 21e of the shell 4 have a substantially square cross-section; as for the front side 21d, it is constituted by an elongate, slightly dished strip with its concavity facing downwardly and joined to the upper face of the sides 21a, 21b. The front side 21d carries a closing component 27 constituting, with the catch 19, the closing device of the compact. The closing component 27 is constituted by a generally V-shaped element. One of the limbs of this V-shaped element is constituted by a bar 28 directly carried by the transverse side 21d and disposed in a plane which is perpendicular to the median plane of the shell 4 and which passes through the median longitudinal line of the side 21d, the bar 28 which thus constitutes the manipulating push button for opening the compact, extending moreover above and below the side 21d. The other limb of the above-mentioned V-shaped component 27 is joined to the base of the bar 28 and forms therewith an acute angle of the order of 45°. It constitutes a catch-engagement arm 29 which terminates in a catch-engagement bead 30 directed towards the outside of the component 27 and delimited by a lower side 30a substantially perpendicular to the plane of the bar 28 and an upper side 30b sloping towards the free end of the side 30a. The V-shaped component 27 is completed by a strip-like channel-shaped cap 31 surmounting the upper portion of the bar 28, the two sides 31a of the cap being bent outwardly at right angles thus constituting a stop 31b whose function will be indicated below.

The shell 4 also comprises moulded elastic tongues 32a, 32b (FIG. 2) on the upper face of the respective lateral sides 21a, 21b of the shell 4 near the respective hinge bearings 22a, 22b.

The assembly of the compact 1 is extremely simple because the shell 4 and the lid 3 can be assembled by firstly introducing the pins 13a, 13b of the lid 3 in the respective recesses 24a, 24b of the respective hinge bearings 22a, 22b, then fitting the thus constituted subassembly in the base 2 by introducing the lateral protuberances 25a, 25b (FIG. 2) of the respective hinge bearings 22a, 22b in the respective slots 26a, 26b of the base 2. Then the shell 4 can be fitted in the base 2 once the V-shaped component 27 has been partly inserted in the space situated between the edge 6a and the rib 8, the bar 28 being parallel to the rib 8, and the catch-engagement arm 29 appearing above the rib 8 as represented for instance in FIG. 4. The apex S, (FIG. 3) of the acute angle formed by the bar 28 and the arm 29 of the V is situated below the plane parallel to the median plane of the compact 1 and passing through the fixed bearing surface 9. The shell 4, thus positioned in the base 2, delimits with the base two compartments 33, 34, that is to say a first compartment 33 surrounded by the sides 21a, 21b, 21c and 21e of the shell 4 and generally containing a tablet of compacted powder, and a second compartment 34 smaller than the first in which a pencil brush or a make-up brush will generally be disposed.

The shell 4 having been thus inserted into the base 2, the lid 3 comes closed, the bead 30 carried by the catch-engagement arm 29 coming to cooperate with the catch 19 and to be placed in the groove 20 which the latter delimits with the plate 10 of the lid 3 by simply resting with its side 30a on the side 18a of the catch 19. In this closed configuration of the lid 3, the bar 28 projects from the lid 3, and the right angled turned back sides 31b of the cap 31 surmounting the bar 28 bear against the internal face of the plate 10 of the lid 3. In this closed configuration, the catch-engagement arm 29 is not under elastic tension; on the other hand, the tongues 32a, 32b bear against the internal wall of the lid 3 to attempt to open the lid 3.

To open the compact 1, the user presses on the outwardly projecting part of the bar 28, which tends to depress the bar into the compact 1, as is indicated by arrow F of FIGS. 4 and 5. Such an action is made possible because of the elasticity of the side 21d, made in the form of a slightly dished strip, and because of the use of a relatively flexible material for the shell 4. During the above-mentioned action, the catch-engagement arm 29 abuts the bearing surface constituted by the upper face 9 of the rib 8, to occupy a position such as is represented in FIG. 4. In this position, the acute angle formed between the bar 28 and the catch-engagement arm 29 decreases slightly and the bead 30 whose face 30a has slid over the face 18a of the catch 19 in the extracting direction, is then released from the groove 20. The opening 15 in the plate 10 of the lid 3 prevents the bead 30 from abutting the plate 10 when the catch-engagement arm 29 is disengaging from the catch 19. The V-shaped component 27 then comes to occupy the solid line position represented in FIG. 5 wherein the lid 3 can open, aided by the action of the tongues 32a, 32b which strain it in the opening direction. (In FIG. 5, the position of the V-shaped component 27 corresponding to the closed configuration of the compact has been represented by dots).

It will be arranged that at the end of travel of the bead 30, the lid 3 can rise so as to come into a position where the raising of the push button can no longer produce the catch-engagement of the catch 19.

Figure 6:
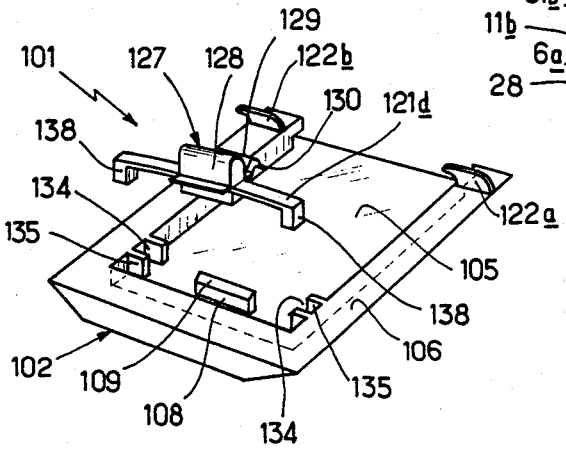
FIG. 6 is an exploded perspective view of the base of a compact in a second embodiment of the invention, and shows the closing component which it comprises.

FIG. 6 of the drawings shows a second embodiment of the present invention, which differs from the first essentially in that the closing component is no longer carried by a shell but by a supporting element with a far simpler structure. The elements which are identical in the two embodiments shown are designated in the second embodiment by reference numerals increased by 100 in relation to those used in the first embodiment.

The support of the V-shaped closing component 127, similar to that of the component 27 of the first embodiment, is constituted by an arm 121d similar to the front transverse side of the shell 4 of the first embodiment. This support therefore consists of a slightly dished strip with downward concavity which, so that it can be fixed to the base 102, is bent at right angles at its two ends so as to constitute tabs 138 which are directed downwardly and which are intended to be accommodated in spaces 134 delimited by channel-shaped elements 135 joined to the bottom 105 of the base 102 along one of their edges.

In this embodiment, the base 102 of the compact 101 can also accommodate a shell which is capable of delimiting, with the bottom 105, a compartment for a cake of cosmetic product and of cooperating with the lid for articulating it on the base 102 in the same way as in the first embodiment. Similarly, the lid comprises a catch, similar to that of the first embodiment, for cooperating with the catch-engagement bead 130 of the V-shaped component 127.

Figure 7:
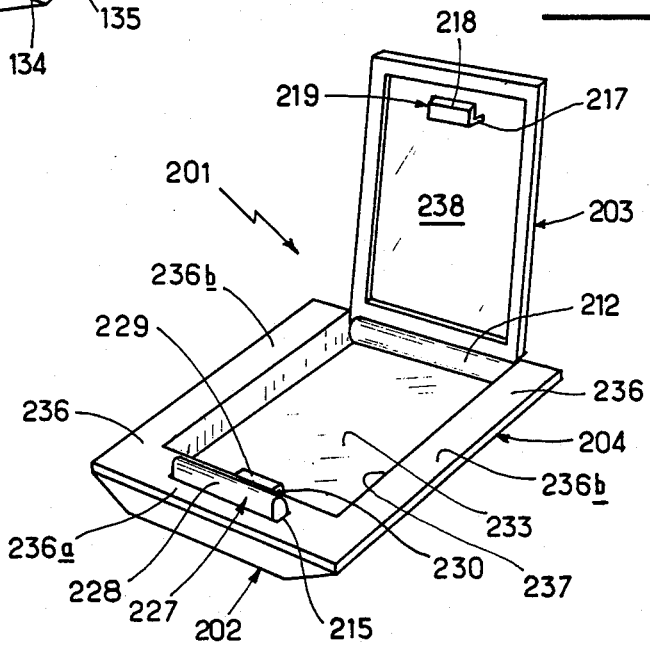
FIG. 7 is a perspective view of a third embodiment of a compact in accordance with the present invention, the casing being represented in the open configuration.

FIG. 7 shows a third embodiment of the compact of the present invention, the reference numerals used to designate this compact being increased by 200 in relation to those used for designating the similar elements of the compact 1 of the first embodiment.

The compact 201 comprises a base 202 identical with the base 102, the base 202 receiving a shell 204 and a lid 203 which are both different from those of the two preceding embodiments.

The shell 204 is constituted by a rectangular plate 236 defining a wide channel-shaped cut out 237 and which is bent at right angles along the edge of the cut out. The strip 236*a* connecting the two lateral sides 236*b* of the plate 236 of the shell 204 has an elongate slot 215 to receive the upper portion of the bar 228 of the V-shaped component 227.

In the assembled configuration, the plate 236 of the shell 204 is flush with the upper edge of the base 202 and delimits at the rear a hinge recess.

The lid 203, whose dimensions are such that in the closed configuration of the compact 201 it is situated in the plane of the plate 236 of the shell 204, comprises a cylindrical boss 212 similar to the boss 12 of the first embodiment and which comprises, in the same way, pins cooperating with the hinge bearings formed at the rear of the shell 204.

Moreover, the lid 203 comprises a catch 219 similar to the catch 19 of the first embodiment. This catch 219 cooperates in the same way as before with the V-shaped component 227 actuated by the outwardly projecting part of the bar 228.

It will also be observed in FIG. 7 that a mirror 238 is fixed, for instance by bonding, to the internal side of the lid 203.

It shall be duly understood that the embodiments described above are in no way restrictive and may give rise to any desirable modifications without thereby departing from the scope of the present invention.

I claim:

1. In a casing comprising:

(a) a base;

(b) a lid, said lid including a slot defining a passage therethrough;

(c) hinge means pivotably mounting said base and said lid on each other;

(d) closing means maintaining said lid and said base applied against each other in the closed configuration of the casing said closing means comprising at least one pair of complementary first and second components, each carried by a respective one of the lid and the base, for fixing the base and lid together, said first component of said at least one pair being movable in order to allow the actuation of said closing means and to actuate the closing and opening of said casing;

the improvement wherein:

(e) said first component of said at least one pair comprises, on the one hand, a manipulating push button which projects through said passage in said lid and from the casing in the closed configuration of the casing and, on the other hand, a relatively flexible catch-engagement arm joined to the proximal end of said manipulating push button;

(f) said manipulating push button and said catch-engaging arm form an acute angle between them;

(g) said catch-engagement arm includes at its distal end a catch-engagement bead extending laterally away from said manipulating push button;

(h) said second closing component is a catch carried by the other of the lid and the base of the casing, said catch being capable of cooperating with said catch-engagement bead to ensure the closure of casing;

(i) said one of the lid and the base of the casing comprises means defining a fixed bearing surface which said catch-engagement arm abuts during the action of depressing the manipulating push button to release said catch-engagement bead from said catch when the compact is in the closed configuration; and (j) in said closed configuration the apex of said acute angle defined by the manipulating push-button and the catch-engagement arm of the first component of said at least one pair constituting the closing means is then below the plane parallel to the median plane of the casing which passes through said fixed bearing surface, said push-button being disposed to be movable in a direction substantially perpendicular to said median plane of the casing;

(k) said base including a bottom surrounded by a ledge except for a rear portion thereof which includes a clearance for receiving said hinge means.

2. A casing according to claim 1, wherein said manipulating push button of said at least one pair of components is disposed substantially perpendicular to said median plane of the casing.

3. A casing according to claim 1, wherein the manipulating push button and the catch-engagement arm of the first component of said at least one pair of components of the closing means together form an acute angle of about 45°.

4. A casing according to claim 1, including a flexible strip supporting said first component of said at least one pair in the said one of the lid and the base of the casing, said flexible strip being fixed at each one of its ends to the said one of the lid and the base of the casing.

5. A casing according to claim 4, wherein the manipulating push button and the catch-engagement arm of said first component of said at least one pair constitute a single part moulded of relatively flexible plastic material; and wherein the flexible strip is obtained by moulding together with said first component of said at least one pair of components.

6. A casing according to claim 4, including an intermediate shell supporting said first component of said at least one pair constituting the closing means; wherein said intermediate shell is mounted in the base and delimits with the shell at least one compartment of the casing; and wherein the flexible strip forms part of the intermediate shell.

7. A casing according to claim 1, including a member fixed to said one of the lid and the casing and a flexible strip supporting said first component of said at least one pair in the said one of the lid and the base of the casing, said flexible strip being fixed at each one of its ends to said member fixed to said one of the lid and the base.

8. A casing according to claim 1, wherein the manipulating push button and the catch-engagement arm of said first component of said at least one pair constitute a single part moulded of relatively flexible plastic material.

9. A casing according to claim 1, wherein said first component of said at least one pair constituting the closing means is carried by the base, and the catch constituting the second component and intended to cooperate with the catch-engaggement bead of the first component of said at least one pair is carried by the lid of the casing.

10. A casing according to claim 9, including an intermediate shell supporting said first component of said at least one pair constituting the closing means; said intermediate shell being mounted in the base and delimiting with the shell at least one compartment of the casing.

11. A casing according to claim 9, wherein the base includes a rib whose upper edge constitutes a bearing surface against which the catch engagement arm is capable of bearing.

12. A casing according to claim 9, wherein in the closed configuration of said casing, the manipulating push button passes through the lid of the casing.

13. A casing according to claim 9, including an intermediate shell mounted in the base and delimiting with the base at least one compartment of the casing; and wherein in the closed configuration, the manipulating push button passes through said intermediate shell.

14. A casing according to claim 9, wherein the lid comprises an opening allowing the catch-engagement bead to be released from the catch during the action of opening the casing.

15. A casing according to claim 1, wherein the manipulating push button comprises a stop limiting its displacement in the directionof extraction from the casing when the casing is closed.

16. A casing according to claim 1, when in the form of a make-up compact.

17. The casing as claimed is claim 1 wherein said pushbutton includes hood means with said hood means including flange means for engaging the internal face of said lid when disposed over said projecting portion of said push-button.

* * * * *